US009685144B2

(12) United States Patent
Trinca

(10) Patent No.: US 9,685,144 B2
(45) Date of Patent: Jun. 20, 2017

(54) TOY PIANO

(71) Applicant: Leonard Trinca, St. Augustine, FL (US)

(72) Inventor: Leonard Trinca, St. Augustine, FL (US)

( * ) Notice: Subject to any disclaimer, the term of this patent is extended or adjusted under 35 U.S.C. 154(b) by 246 days.

(21) Appl. No.: 14/214,782

(22) Filed: Mar. 15, 2014

(65) Prior Publication Data

US 2015/0262558 A1 Sep. 17, 2015

(51) Int. Cl.

| | |
|---|---|
| ***A63H 5/00*** | (2006.01) |
| ***G10C 3/04*** | (2006.01) |
| ***G10D 13/08*** | (2006.01) |
| ***A63H 33/30*** | (2006.01) |

(52) U.S. Cl.

CPC ..... *G10C 3/04* (2013.01); *A63H 5/00* (2013.01); *A63H 33/30* (2013.01); *G10D 13/085* (2013.01)

(58) Field of Classification Search

CPC .... G10F 1/06; G10F 5/00; A63H 5/00; G10C 3/06; G10C 3/12; G10C 1/00; G10D 13/085

USPC ..... 84/94.1, 94.2, 95.1, 95.2, 173, 174, 184; 446/81, 143

See application file for complete search history.

(56) References Cited

U.S. PATENT DOCUMENTS

| | | | | |
|---|---|---|---|---|
| 2,293,102 A * | 8/1942 | Berger | G10D 13/085 84/404 |
| 2,882,778 A * | 4/1959 | Scott | 84/95.2 |
| 5,103,707 A * | 4/1992 | Hogue | 84/192 |

* cited by examiner

*Primary Examiner* — Kimberly Lockett
(74) *Attorney, Agent, or Firm* — Steven R. Scott

(57) ABSTRACT

A toy piano including one or both an enlarged sound plate intermediate the sound bar of the toy piano and its sound board, and a sound box into which the sound board is incorporated. Preferably, the sound plate extends beyond the normal edges of the sound bar in which the longitudinal tines of the toy piano are mounted so as to lie adjacent to the sound board over a larger area. Likewise, the sound box should preferably be shaped so as to be somewhat wider (measured in the longitudinal direction of the tines) towards the end where the tines are longest (and produce lower tones) and somewhat narrower towards the end where the shorter tines (producing higher tones) are located. It preferred shape is characterized by somewhat convex curves at the more treble and bass ends, respectively, of the sound box with a somewhat concave curve intermediate these two ends. The backboard of the sound box can be bowed outward for enhance acoustics.

16 Claims, 6 Drawing Sheets

TOY PIANO

CROSS REFERENCE TO RELATED APPLICATIONS

This application claims priority to U.S. Provisional Application Ser. No. 61/802,122 titled "Toy Piano" filed Mar. 15, 2013, the same being incorporated herein by reference.

BACKGROUND AND SUMMARY

My invention pertains generally to the design of baby grand and upright toy pianos, more particularly to toy pianos utilizing tines in sound production. Even more specifically, my invention deals with improvements to the mounting of tines on sound boards and other improvements to toy pianos that act to multiply and improve the quality of sound produced.

The essential parts of a toy piano are the same in both the baby grand and the upright version of the toy piano. Overall the piano has a predetermined shape created by joining a plurality of planar side forming members including a bottom member and a plurality of side members, which side members include a back side member, a front side member, and lateral side members. The lateral side members are generally secured to the bottom side of the piano. The two lateral side members, a back side member and a front side member form an enclosure around the interior components of the piano.

Fixed within the interior of the enclosure that is formed will, in most toy pianos, be a sound board that assists in producing musical tones when the toy piano is played. A plate or protective covering may be placed above the sound board to protect the sound board. Over the top of the protective plate will be the top member which forms the top surface of the piano/enclosure. The top member will mate with the lateral side members, back side member and front side member of the piano to complete the enclosure that houses the sound board. These sides will be constructed from pre-sized pieces to fit a variety of pianos that will be connected by a connector of some type.

On the front of the piano will be a set of keys, both white and black, by which the toy piano can be played. Toy pianos are generally smaller than a typical piano and usually have around eighteen to forty-nine keys although there are some variations. A front member that forms part of the enclosure that houses the sound board will be placed perpendicular to the keys and will usually be connected to the bottom surface of the piano.

Generally speaking, a sound board is the surface of a stringed instrument adjacent to the strings. The strings vibrate against the soundboard, usually via some sort of bridge support which acts as a conductor for the vibrations produced by the string. The resonant properties of the sound board serve to greatly increase the volume of the tone produced by the vibrations of the string. In short, the sound board (being connected to the string via the bridge) is forced to vibrate at the same frequency as the string, producing the same sound as the string alone, but differing in timbre. Due to the greater surface area of the sound board, it is able to more readily transform the vibrations of the string into sound as it is in contact with (and vibrates) a larger volume of air, thereby producing a louder sound.

In a piano, the sound board is usually a large horizontal plate at the bottom of the case. In an upright piano, the sound board is a large vertical plate at the back of the instrument. However, rather than strings being struck by a hammer actuated by a piano key, toy pianos—as originally and classically produced—use metal plates or tines. In most modem toy pianos, these are connected to a soundboard. The tines act like chimes, producing a musical tone when struck by the hammer. However, as the toy piano, the tines producing its musical tones, and its sound, board are far smaller than equivalent parts on a real piano, sound production of adequate volume and quality remains a distinct problem. In addition, the usual mode of mounting the tines to the sound board of a toy piano act to dampen and/or even eliminate vibration of its adjacent sound board (when one is present). Finally, neither pianos nor toy pianos have sought to incorporate a sound box to further increase resonance and thereby multiply and improve the quality of sound produced. (A sound box is a chamber with an opening or openings in the body of a musical instrument that is adapted to modify the sound of the instrument, adding resonance and reinforcing sound quality, particularly at lower frequencies).

Thus, my invention comprehends not only innovations in the mounting of the tines in a toy piano so as to facilitate and enhance the function of a toy piano sound board, but the introduction and use of sound boxes in toy pianos, to further assist in enhancing and improving the quality of sound produced. In these regards, I introduce a sound plate extending beyond the normal edges of the sound bar in which the longitudinal tines of the toy piano are mounted so as to lie adjacent to the sound board over a larger area as well as introducing a dedicated sound box for the improvement of the quality, tone and volume of sound produced. The sound box should, ideally, be shaped so as to be somewhat wider (measured in the longitudinal direction of the tines) towards the end where the tines are longest (and produced lower tones) and somewhat narrower towards the end where the shorter tines (producing higher tones) are located. However, this is a very general observation. More particularly, I have discovered that, in general, a multi-curved shape opposite the side where the tines are mounted—somewhat like that of one half of a guitar or ukulele (i.e., two convex curves with an intermediate concave curve)—provides the best and most resonant sound quality. These and other preferred features of my invention will be discussed in more detail below.

DESCRIPTION

This is a specification for a toy piano having an improved sound board and/or a sound box, both of which are intended to, and function as, means for enhancing the sound volume and quality of the toy piano. Toy pianos can be manufactured to resemble and function like a grand (or baby grand) piano 1 or an upright piano. Regardless of the manufacturer, this process and the teachings of this invention will be applicable to either kind of toy piano.

Figure 1:
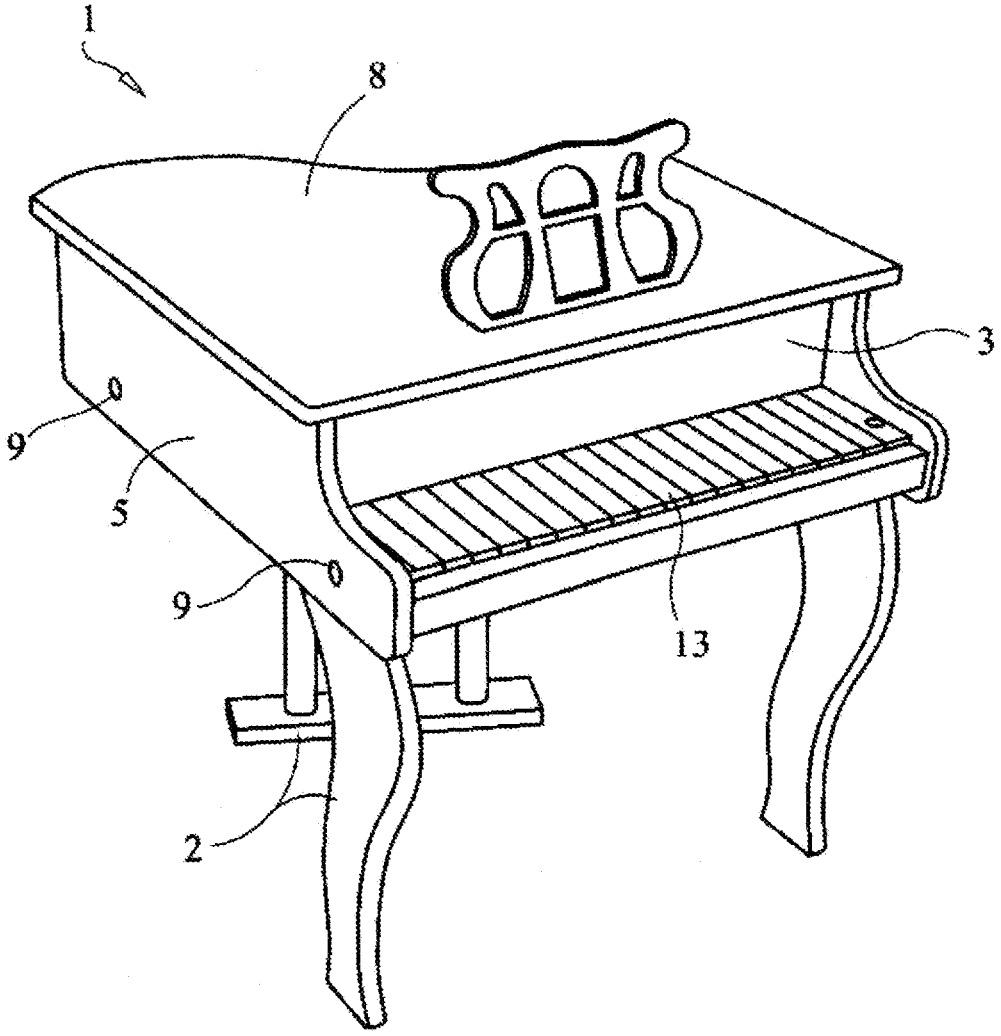
FIG. 1 (PRIOR ART)
FIG. 1 provides a perspective view of a prior art baby grand toy piano in accordance with current teachings in the art.
Figure 2:
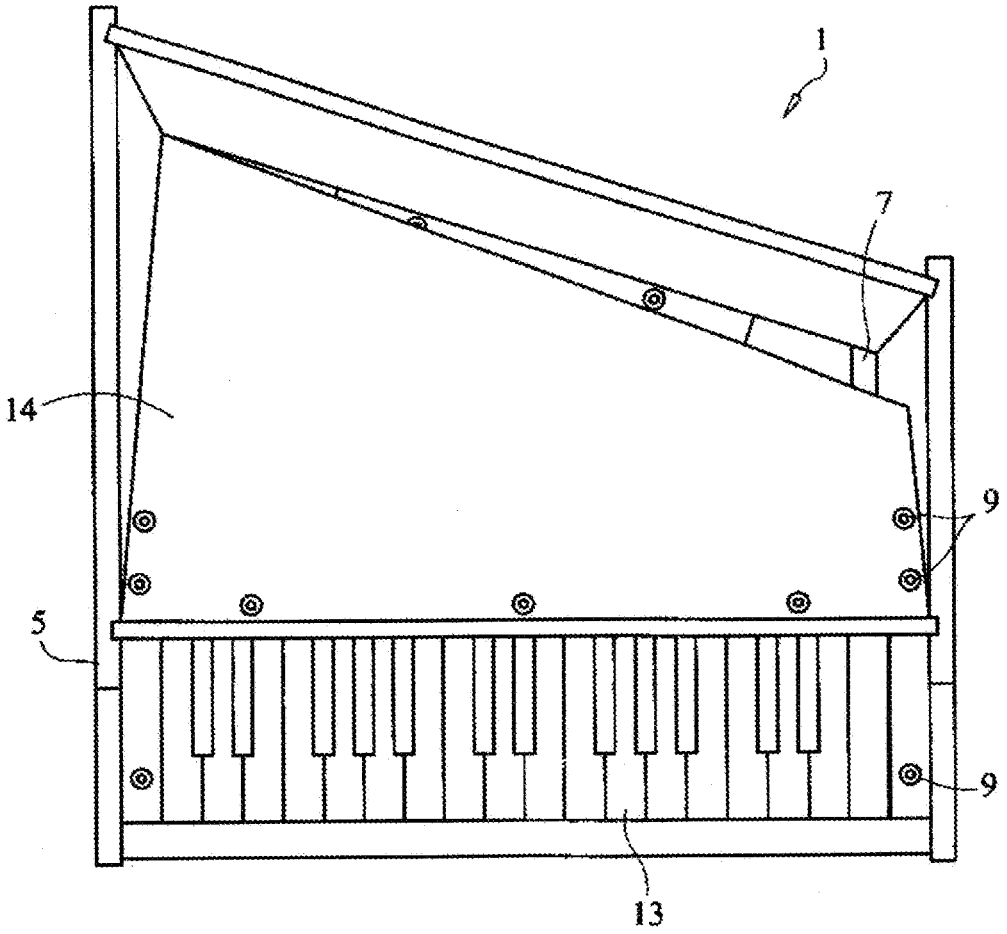
FIG. 2 (PRIOR ART)
FIG. 2 provides a top view of the baby grand toy piano of FIG. 1 showing the protective plate.
Figure 3:
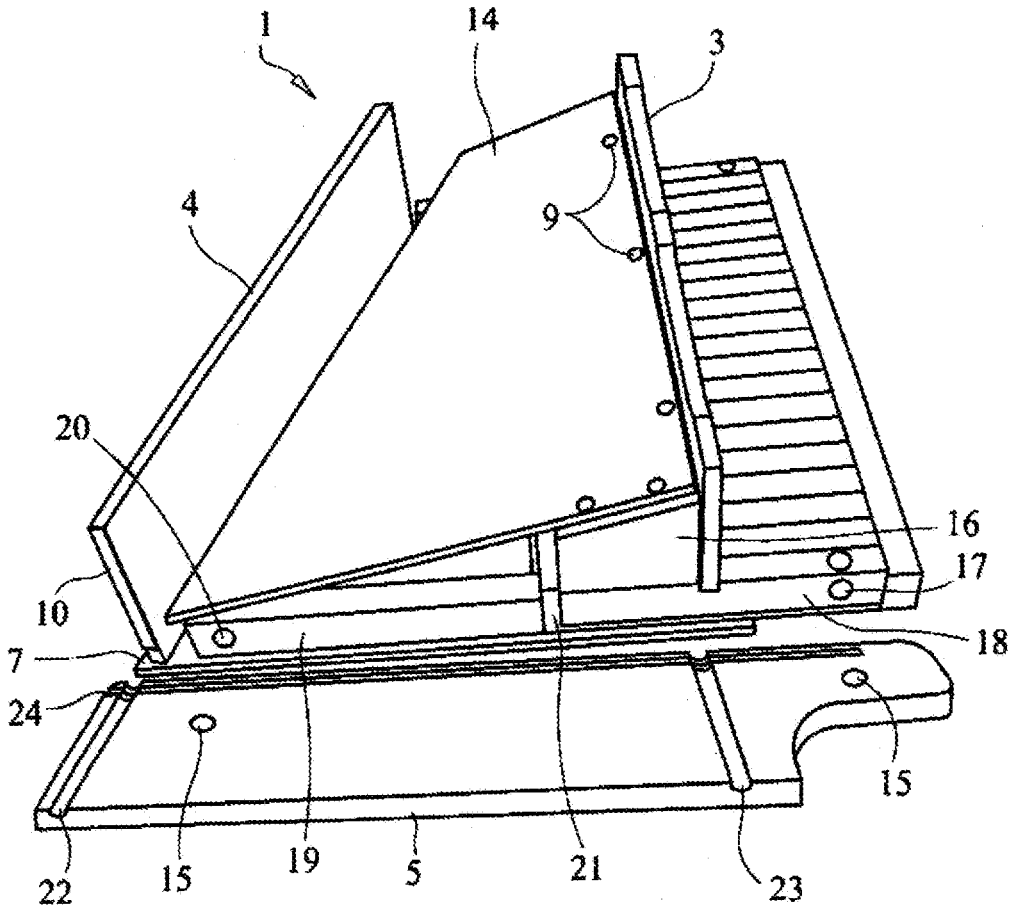
FIG. 3 (PRIOR ART)
FIG. 3 provides a partially disassembled side perspective view of the baby grand piano of FIG. 1.

An initial understanding of the construction and components of a toy piano 1 can be derived from review of FIGS. 1 through 3, and even more particularly by my prior U.S. Pat. No. 8,013,227, which is incorporated herein by reference. As will be noted, the toy piano 1 is, in many respects, a miniature version of a real piano. Toy pianos 1 have a very distinctive sound when played which differentiates them from the sound of a standard piano. Like a standard piano a toy piano 1 has a set of keys 13 that are played by a person. Toy pianos 1 are typically played by children and are usually given as a first piano or as a learner piano. Toy pianos 1 also have a limited number of keys 13, as opposed to the 88 keys that are found on most standard upright or grand pianos. However, a person plays the toy piano 1 in the same manner as a standard piano, although typically the sound on a toy piano 1 is different than a standard upright or grand piano, as it is derived from a different source (tines/chimes) rather than strings The toy piano 1 is typically supported by legs 2 attached to the bottom member 7 of the piano 1 by a threaded member (although there are a variety of ways to attach a piano leg). The bottom surface of the bottom member 7 of the piano is typically planar and can advantageously form one of the surfaces on which the interior components of the piano will rest and be housed in the piano 1. (It is preferably perforated with numerous holes to facilitate and allow sound produced within its interior to be heard). Joined to this planar surface will be two lateral side members 5. Front side member 3 and back side member 4 are joined to these lateral side members 5. Finally, a top member 8 will, when joined together with the aforesaid side members form an enclosure and cavity that will house interior parts of the piano. When the piano is assembled the interior components of the piano will be protected by this casing.

Additionally, the keys 13 of the piano will usually be placed on the planar bottom member 7 and positioned exterior to the cavity; the front side member 3 will be positioned so that the interior components of the piano cannot be damaged. The lateral side members 5 and the back member 4 will be attached to each other at or near their respective ends. The end 10 of the back member will be manufactured so that this portion will fit into a second groove 22 on the surface of the side members 5. A first groove 23 will allow the side members 5 to be attached to front member 3. As it is imperative that the sound board 6 be protected as much as possible, a protective plate 14 may be placed between the sound board and the top member 8 of the piano. Further, the top member 8 of the piano will protect the interior component once it is placed on the piano.

Figure 4A:
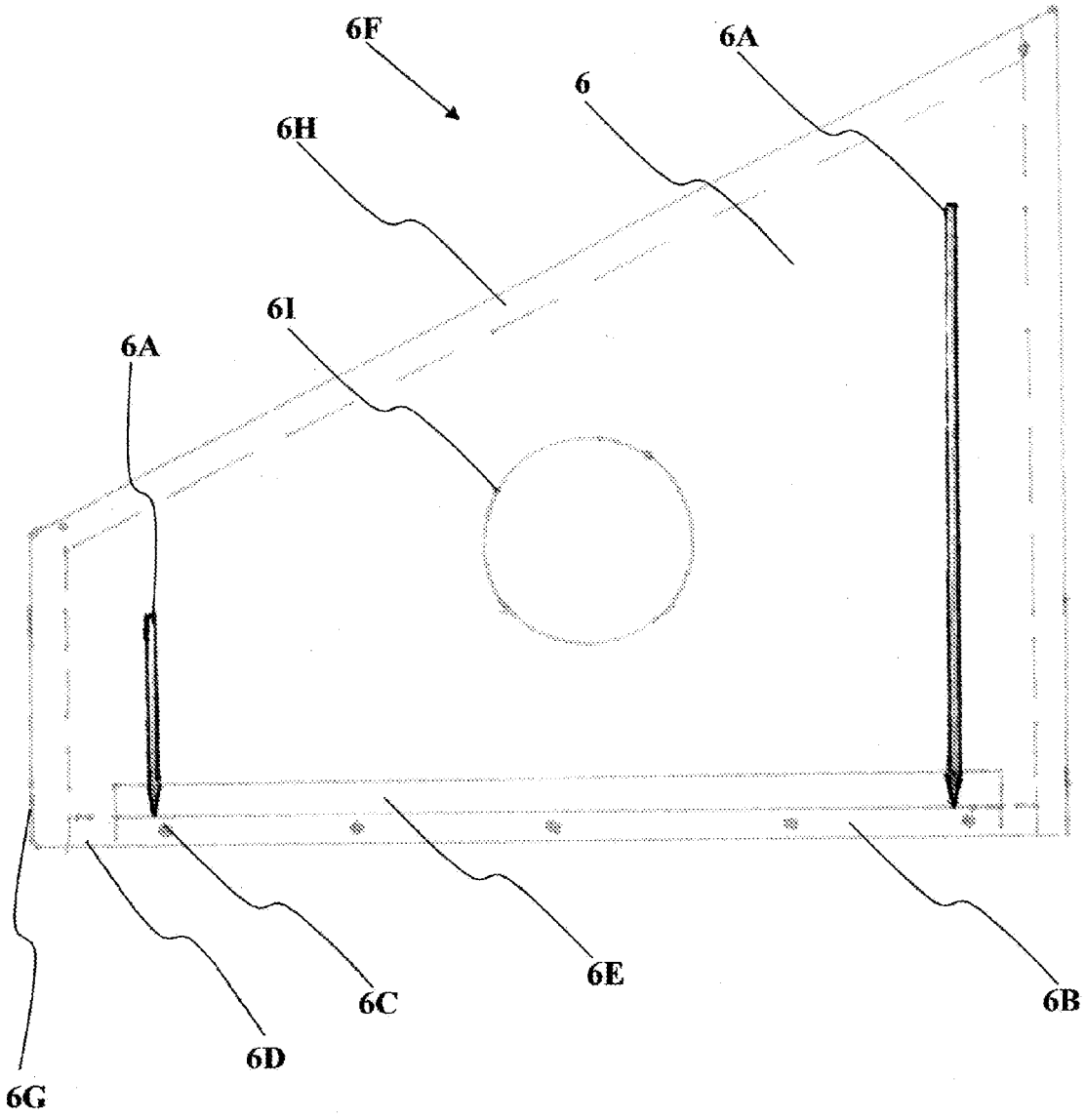
FIG. 4A provides a schematic view from underneath of a basic embodiment of a sound box for a toy piano in accordance with the teachings of my invention.
Figure 4B:
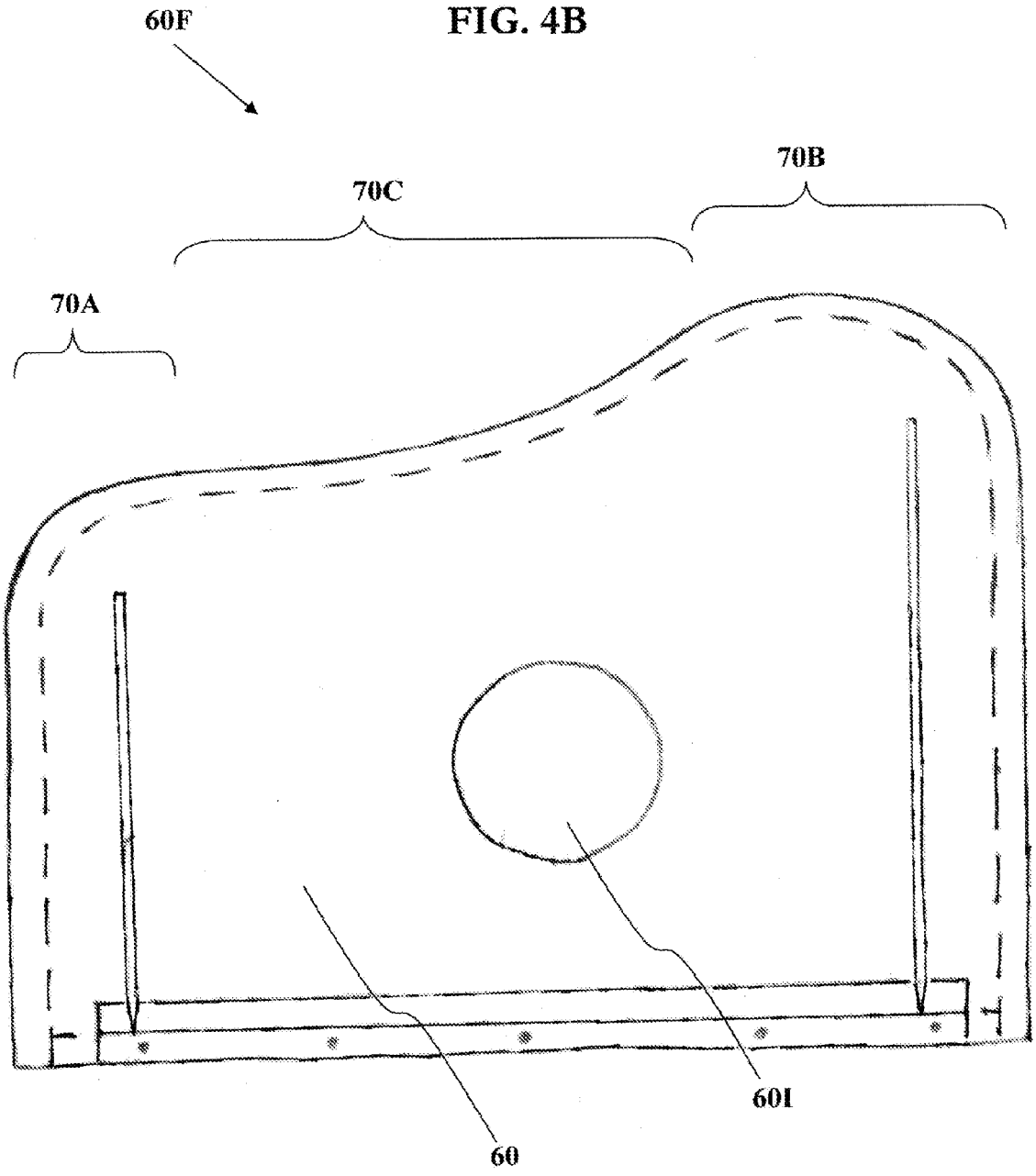
FIG. 4B provides a schematic view from underneath of a preferred embodiment of a sound box for a toy piano in accordance with the teachings of my invention.
Figure 5:
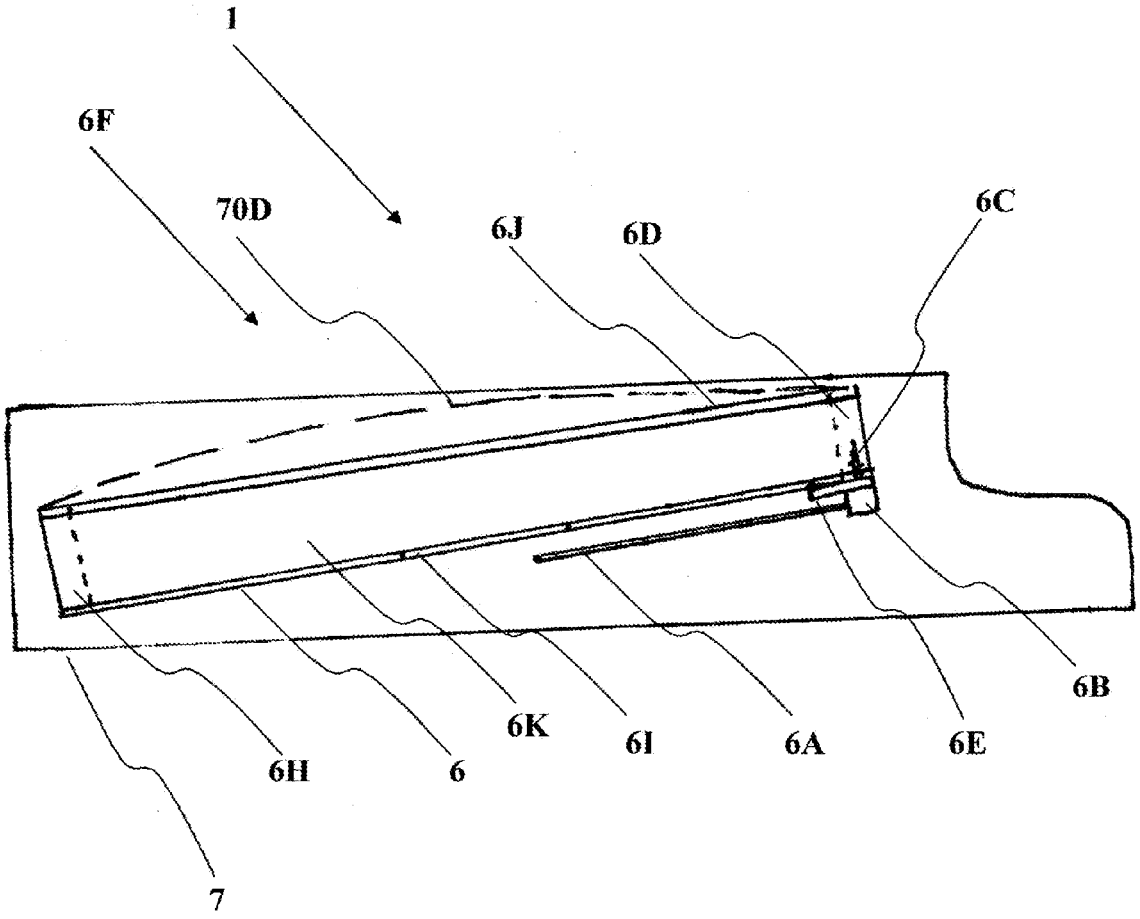
FIG. 5 provides a schematic side view of the sound boxes illustrated in FIGS. 4A and 4B as they might be positioned in a toy piano.

The variations I have found and discovered to be beneficial, can now be understood in reference to FIGS. 4A through 5. As previously mentioned, the sound board 6 for the piano 1 is located inside the enclosure/compartment formed by the side members 5, the back member 4, bottom member 7, and the front member 3. The sound board 6, 60 is a board with a series of rods of tines 6A that will produce the sound of the piano when the tines 6A are struck by hammers (not shown) that are connected to the keys 13 of the piano. (Only a limited number of tines 6A are illustrated in FIGS. 4A through 5 to avoid overcrowding of the drawing figures; however, it should be understood that there will typically be a tine 6A associated with every key of the piano 1). In keeping with prior art, levers (not depicted) are attached to the keys 13 of the piano and are attached to hammers that strike the tines 6A of the sound board 6. The metal tines 6A are mounted to sound board 6, 60 via a metal sound bar 6B which is, in turn, mounted (typically by screws 6C or some other fastening member to a solid support member 6D). However, as will be evident from FIGS. 4A through 5, three principle innovations distinguish my invention from prior art: (1) the inclusion of an enlarged sound plate 6E intermediate sound bar 6B and soundboard 6, 60; (2) the incorporation (in contrast to prior pianos and toy pianos) of the soundboard 6, 60 into a sound box 6F, 60F; and (3) the provision of a multi-curved side opposite the side where the sound bar 6B is mounted.

As a preface to the first improvement, it should be mentioned that it is generally necessary for the sound bar 6B (in which and to which tines 6A are mounted) to be fastened securely to a fairly heavy member such as a wooden support wall 6D for support purposes. Thus, unlike the bridge of a stringed instrument, sound bar 6B does not form an unsupported link between the initial source of vibration (tines 6A) and the sound board 6 so as to efficiently convey vibrations from tines 6A to soundboard 6, 60. (In contrast to this, the bridge of a stringed instrument is usually anchored in place between strings and soundboard with nothing underneath the soundboard but the open interior of the instrument's sound box, facilitating transfer of vibrations between bridge and soundboard as well as interior resonance). In fact, the sound bar 6B in prior art is solidly secured in a way that acts to deaden and dampen its ability to convey the vibrations produced in tines 6A to soundboard 6, 60. In addition, soundboard 6, 60 is also firmly anchored by and between the sound bar 6B and support wall 6D), so as to dampen its ability to vibrate and/or be vibrated by the sound bar 6B. Thus, both in terms of the ability of sound bar 6B to convey vibrations and/or the soundboard 6, 60 to vibrate therewith, the current method of anchoring components—though advantageous for a variety of other reasons—serves to dampen and hamper the function of soundboard 6, 60.

However, I have discovered that the placement of a metal sound plate 6E intermediate sound bar 6B and extending out over, and in contact with, soundboard 6, 60 can alleviate and/or supersede this problem. The sound plate 6E (typical diameter 1.25") extends out past sound bar 6B (typical diameter ⅝") over soundboard 6, 60 beyond the diameter (typically 0.75") of support wall 6D so as to maintain direct contact with soundboard 6, reach beyond the dampening influence of support wall 6D, and thereby serve to facilitate communication of vibrations from tines 6A via sound bar 6B through sound bar 6E to soundboard 6, 60, with a distinctive and noticeable improvement in the quality and volume of sound produced. In prior art, the link from tines 6A through sound bar 6B to soundboard 6, 60 was made less effective in terms of conveying sound vibrations by the deadening impact produced by anchoring sound bar 6B to a support wall or member 6D and sandwiching the soundboard 6, 60 therebetween. However, the placement of a sound plate 6E as described helps to bypass and eliminate this problem by conveying these vibrations directly between the sound bar 6B and the soundboard 6, 60 beyond the areas where it is anchored and thereby largely immobilized in terms of vibration. (The drawings of the sound plate 6E should not be seen as, and are not intended to be, limiting in terms of its dimensions and shape, which may vary and is subject to further experimentation to achieve optimum function, especially as coupled with different soundboard 6, 60 and soundbox 6F, 60F shapes).

As to the second improvement, I have found that incorporating a soundboard 6, 60 into a hollow sound box 6F, 60F will also serve to greatly improve the volume and quality of sound produced. Thus, FIGS. 4A through 5 shows the soundboard 6, 60 incorporated into an appropriately shaped sound box 6F, 60F. The sound box 6F, 60F and its various components can advantageously be constructed with ¾" wood or other suitable materials comprising support wall 6D, sidewalls 6G, and distal wall 6H with appropriate shape and dimensions to fit within the piano 1. FIG. 4A shows a basic embodiment of a soundbox 6F meeting this requirement. As will be noted in reviewing FIGS. 4A and 4B, the soundbox 6F, 60F of the invention should, preferably, be shaped so as to be somewhat wider (measured in the longitudinal direction of the tines 6A) towards the more bass end where the tines 6A are longest (and produced lower tones) and somewhat narrower towards the more treble end where tines 6A are shorter (and produce higher tones). Further, in explanation of the differences illustrated and shown between the basic embodiment illustrated in FIG. 4A, the preferred embodiment illustrated in FIG. 4B: I have discovered that a shape characterized by somewhat convex curves 70A, 70B at the more treble and bass ends, respectively, of the sound box 60F with a somewhat concave curve 70C intermediate these two ends (all as illustrated in FIG. 4B) provides the best and most resonant sound quality.

An intermediate shape between that shown in FIG. 4A and that shown in FIG. 4B is also beneficial and is produced by eliminating the sharp angles where side walls 6G meet distal wall 6H—which trap and/or otherwise diminish sound production and resonance—by gradual convex curves 70A, 70B which bound sound waves back towards sound hole 6I, but the best results are achieved by also replacing the portion of distal wall 6H intermediate convex curves 70A, 70B with a gradual concave curve 70C. Concave curve 70C preferably follows a curve dictated by the formula used for increasing the length of tines 6A between the more treble end (adjacent convex curve 70A) and the more bass end (adjacent convex curve 70B) whereby each lower full step produces a tine 6A $1/17^{th}$ longer than the prior tine and each half step produces a tine $1/34^{th}$ longer than the prior tine). Consequently, intermediate concave curve 70C generally runs parallel to and remains approximately equidistant from the distal ends of tines 6A adjacent to concave curve 70C. Thus, in the preferred shape shown in FIG. 4B, there are no abrupt corners at distal wall 6H and the adjacent edge of sound board 60. Instead, the corner areas 70A, 70B are curved, with a gently curved section 70C therebetween, producing the distinctive preferred shape for the soundbox 60F and its soundboard 60, illustrated in FIG. 4B. It has been found that this shape is far more resonant and helps to more effectively bounce sound produced by the tines 6A back towards the sound hole 60I. Sound can be even further improved by providing a curved acoustic back (which would be curved away from soundhole 60I as shown by broken line 70D in FIG. 5). All of the foregoing can be advantageously produced by the use and production of molded plastic sound boxes in accordance with the teachings of the invention.

As will be noted, and in keeping with the normal arrangement of a soundboard 6 with its tines 6A in a toy piano 1, the sound box 6F is inverted so that its sound hole 6I faces downward. This is in keeping with the usual construction of toy baby grand pianos where the tines 6A are bottom-most and (as previously noted) apertures/holes in bottom member 7 assist in the communication of sounds produced to the exterior of piano 1. However, other orientations are possible. In terms of other critical dimensions, the walls 6D, 6G, 6H of the sound box 6F are typically 2" in height with the material forming soundboard 6 and backboard 6J have a thickness of approximately 3 nm, giving the sound box 6F an approximate thickness of 2.5", and thereby requiring in most cases a slight increase (approximately 2") in the height of the piano 1.

However, numerous variations are possible without deviating from and/or exceeding the spirit and scope of my invention. Thus, as the foregoing should also make clear, numerous variations can be made without exceeding the inventive concept. Moreover, several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the claims that follow.

Finally, the following parts list for the drawing figures may be found to be of assistance in understanding more fully the concepts of my invention:

1—Baby Grand Toy Piano
2—Legs/Support Members
3—Front Member
4—Back Member
5—Side Members
6—Sound Board
6A—Tines
6B—Sound Bar
6C—Screws
6D—Support Wall
6E—Sound Plate
6F—Sound Box
6G—Side Walls
6H—Distal Wall
6I—Sound Hole
6J—Back Board
6K—Sound Box Interior
7—Bottom Member
8—Top Member
9—Connectors
10—Side of back member
13—Keys
14—Protective Plate
15—Hole in Side Member
16—Stop Piece Housing
17—Hole for Connector
18—Horizontal Stop Piece
19—First Horizontal Stop Piece
20—Hole for Connector
21—Vertical Stop Piece
22—Second Groove
23—First Groove
24—Slits
60—Preferred Soundboard shape
60F—Preferred Soundbox shape
70A—Convex Curve at Treble End
70B—Convex Curve at Bass End
70C—Concave Curve Intermediate 70A and 70B
70D—Acoustically Curved Backboard (The function of other components denoted in the drawing figures and named above, where not discussed in detail herein, can be determined from review of U.S. Pat. No. 8,013,227, which is incorporated herein by reference).

What is claimed is:

1. A toy piano, comprising:

a predetermined piano shape;

a sound board secured within said piano shape having a sound conducting soundbar affixed thereto, which soundbar includes sound producing tines, such that sounds produced by said sound producing tines are conducted by said soundbar to said sound board; and a sound plate intermediate said soundboard and said soundbar that facilitates communication of sound between said soundbar and said sound board, which sound plate does not serve to attach said soundbar and sound board.

2. A toy piano, comprising:

a predetermined piano shape;

a sound board secured within said piano shape having a sound conducting soundbar affixed thereto, which soundbar includes sound producing tines, such that sounds produced by said sound producing tines are conducted by said soundbar to said sound board; and a sound plate intermediate said soundboard and said soundbar that facilitates communication of sound between said soundbar and said sound board; and wherein said sound plate is a sound conducting planar member that extends across and adjacent said soundboard so as to facilitate communication of sound therebetween.

3. The toy piano of claim 2, wherein at least one of said sound plate and said sound bar are formed from metal, said sound plate and said sound bar are in direct physical contact, said sound plate and said sound board are in direct physical contact, said sound plate contacts an area of said soundboard greater than an area of said soundboard contacted by said sound bar, and said sound plate contacts an area of said soundboard greater than an area of said soundboard contacted by a support wall to which said soundboard is attached.

4. The toy piano of claim 2, wherein said soundboard is incorporated into a hollow sound box formed by said soundboard, an opposing back board, and side walls transverse to and separating said soundboard and back board such that said sound board, back board and side walls surround and define a sound box interior.

5. The toy piano of claim 3, wherein said soundboard is incorporated into a hollow sound box formed by said soundboard, an opposing back board, and side walls transverse to and separating said soundboard and back board such that said sound board, back board and side walls surround and define a sound box interior.

6. The toy piano of claim 4, wherein said walls include a wall adjacent said sound bar, a distal wall opposite therefrom, and two lateral walls connecting said adjacent and distal walls, where at least one of:

the lateral wall adjacent higher pitched tines is shorter in length than the lateral wall adjacent lower pitched tines, and the distal wall has at least one of a straight section, a curved section, a convex curved section joining said distal wall to another side wall, a concave curved section, and convex curved sections joining said distal wall to other side walls and a concave curved section intermediate said convex sections.

7. The toy piano of claim 5, wherein said walls include a wall adjacent said sound bar, a distal wall opposite therefrom, and two lateral walls connecting said adjacent and distal walls, where at least one of:

the lateral wall adjacent higher pitched tines is shorter in length than the lateral wall adjacent lower pitched tines, and the distal wall has at least one of a straight section, a curved section, a convex curved section joining said distal wall to another side wall, a concave curved section, and convex curved sections joining said distal wall to other side walls and a concave curved section intermediate said convex sections.

8. The toy piano of claim 6, wherein any said concave curved section is curved so as to remain approximately equidistant from terminal ends of tines proximate thereto.

9. The toy piano of claim 7, wherein any said concave curved section is curved so as to remain approximately equidistant from terminal ends of tines proximate thereto.

10. A toy piano, comprising:

a predetermined piano shape;

a sound board secured within said piano shape having a sound conducting soundbar affixed thereto, which soundbar includes sound producing tines, such that sounds produced by said sound producing tines are conducted by said soundbar to said sound board;

wherein said soundboard is incorporated into a hollow sound box formed by said soundboard, an opposing back board, and side walls transverse to and separating said soundboard and back board such that said sound board, back board and side walls surround and define a sound box interior; and wherein said walls include a wall adjacent said sound bar, a distal wall opposite therefrom, and two lateral walls connecting said adjacent and distal walls, where at least one of:

the lateral wall adjacent higher pitched tines is shorter in length than the lateral wall adjacent lower pitched tines, and the distal wall has at least one of a straight section, a curved section, a convex curved section joining said distal wall to another side wall, a concave curved section, and convex curved sections joining said distal wall to other side walls and a concave curved section intermediate said convex sections.

11. The toy piano of claim 10, wherein any said concave curved section is curved so as to remain approximately equidistant from terminal ends of tines proximate thereto.

12. A toy piano, comprising:

a predetermined piano shape;

a sound board secured within said piano shape having a sound conducting soundbar affixed thereto, which soundbar includes sound producing tines, such that sounds produced by said sound producing tines are conducted by said soundbar to said sound board;

wherein said soundboard is incorporated into a hollow sound box formed by said soundboard, an opposing back board, and side walls transverse to and separating said soundboard and back board such that said sound board, back board and side walls surround and define a sound box interior; and wherein at least one of said sound box includes a sound hole leading into the interior of the sound box, said sound box includes a downward facing sound hole leading into the interior of said sound box, and said sound box includes a sound hole in its sound board.

13. The toy piano of claim 10, wherein at least one of said sound box includes a sound hole leading into the interior of the sound box, said sound box includes a downward facing sound hole leading into the interior of said sound box, and said sound box includes a sound hole in its sound board.

14. The toy piano of claim 11, wherein at least one of said sound box includes a sound hole leading into the interior of the sound box, said sound box includes a downward facing sound hole leading into the interior of said sound box, and said sound box includes a sound hole in its sound board.

15. The toy piano of claim 14, wherein at least one of: a sound plate intermediate said soundboard and said soundbar facilitates communication of sound between said soundbar and said sound board, and said back board is curved/bowed outward.

16. The toy piano of claim 15, wherein at least one of said sound plate is a sound conducting planar member that extends across and adjacent said soundboard so as to facilitate communication of sound between, said sound plate and said sound bar are formed from metal, said sound plate and said sound bar are in direct physical contact, said sound plate and said sound board are in direct physical contact, said sound plate contacts an area of said soundboard greater than an area of said soundboard contacted by said sound bar, and said sound plate contacts an area of said soundboard greater than an area of said soundboard contacted by a support wall to which said soundboard is attached.

* * * * *